US005457942A

United States Patent [19]

Mantovani

[11] Patent Number: 5,457,942

[45] Date of Patent: Oct. 17, 1995

[54] CLOSING DEVICE FOR SECURING PACKING ENVELOPES

[75] Inventor: Gianni Mantovani, I-Bologna, Italy

[73] Assignee: Bielomatik Leuze GmbH & Co., Germany

[21] Appl. No.: 73,218

[22] Filed: Jun. 4, 1993

[30] Foreign Application Priority Data

Jun. 6, 1992 [DE] Germany ..... 42 18 720.6

[51] Int. Cl.[6] ..... B65B 51/10

[52] U.S. Cl. ..... 53/463; 53/329.2; 53/329.4; 53/375.8; 53/375.9; 53/376.5; 53/377.2; 53/377.4; 53/411

[58] Field of Search ..... 53/329.2, 329.4, 53/375.8, 375.9, 376.2, 376.5, 377.2, 377.4, 411, 463, 387.3

[56] References Cited

U.S. PATENT DOCUMENTS

| | | | |
|---|---|---|---|
| 2,254,860 | 9/1941 | Rose | 53/376.2 |
| 3,325,969 | 6/1967 | Bemiss et al. . | |
| 4,220,847 | 9/1980 | Focke et al. . | |
| 5,175,978 | 1/1993 | Knauf . | |

FOREIGN PATENT DOCUMENTS

| | | |
|---|---|---|
| 2907849 | 9/1979 | Germany . |
| 4034961 | 5/1992 | Germany . |
| 889391 | 2/1962 | United Kingdom . |
| 1148436 | 4/1969 | United Kingdom . |
| WO84/00705 | 3/1984 | WIPO . |

*Primary Examiner*—W. Donald Bray
*Attorney, Agent, or Firm*—Quarles & Brady

[57] ABSTRACT

Layers (14, 15) of the envelope (12) of the packed product (11) overlapped accompanied by the interposing of an adhesive (16) form on one envelope side (13) a strip-like closing field (17) and which for the activation of the adhesive (16) is moved along a corresponding elongated, thermal emitter (9), whose width is roughly the same as the width of the closing field (17). As a result the adhesive (16) does not pass laterally out of the lateral boundaries of the overlap and is instead only activated within its lateral edges (18, 19) by liquefication. The packed product (11) is consequently also thermally treated in a careful manner.

25 Claims, 3 Drawing Sheets

CLOSING DEVICE FOR SECURING PACKING ENVELOPES

BACKGROUND OF THE INVENTION

The invention relates to a closing device, which more particularly permits the firmly adhering closure of covers or envelopes engaging on packed products and which at one envelope side form an overlap or covering portion. This overlap can e.g. be formed by one or two marginal areas of the envelope engaging over one another in approximately equiplanar manner.

Between the facing or equiplanar engaging sides of the layers to be interconnected there is an adhesive, e.g. in the form of a hot glue. This adhesive is firstly applied to the corresponding side of at least one of the layers in the overlap area, but then has little or a very limited adhesive action in the sense of an adhesive connection the two layers, unless it is activated by special measures diverging from normal climatic conditions, i.e. it is at least briefly transferred in reversible manner e.g. from a solid form into a flowable form. The adhesive can be provided in linear or strip-like manner and in the entire field provided with adhesives in continuous or grid-like form in separate individual fields, e.g. successive adhesion points or strip portions.

For activating the solidified adhesive by liquefication an energy matched to the characteristics of the adhesive and namely by thermal energy in the case of a hot glue is required, which is transferred by radiation and/or conduction through the outer layer of the envelope to the adhesive from a corresponding energy emitter. The surface-specific energy quantity suitable for activating the adhesive is made available in the vicinity of the closing device within an energy field bounded in predetermined manner on the outer circumference. Particularly if said energy field extends up to the outer boundaries of the envelope side of the packed product or projects over said outer boundaries in the direction which is at right angles to the direction in which the envelope layers engage over one another, the adhesive can flow in uncontrolled manner in this direction in a now fluid state. The adhesive can flow beyond the overlap area of the envelope, so that in undesired manner it adhesively connects the inside of the envelope with the pecked product and/or the outside of the envelope with equipment parts and can lead to a significant dirtying effect. The lateral passing out of the activated adhesive from the overlapped area can optionally also take place if the energy field projects in the overlap direction beyond the lateral boundaries thereof.

OBJECTS OF THE INVENTION

An object of the invention is to provide a closing device of the aforementioned type, which makes it possible to avoid the disadvantages of known constructions and of the aforementioned type and which in particular in the case of a simple construction ensures an accurately controlled extension or expansion of the adhesive in the activated state.

SUMMARY OF THE INVENTION

One feature of the invention is that the energy field of the emitter in which the layers of the envelope engage over one another on the envelope side by overlap, does not project or only insignificantly projects over the envelope side on one or both facing outer boundaries of said envelope side or may even be set back with respect to the particular outer boundary of the envelope side. Therefore the envelope closing field defined from the width standpoint by the overlapped area of the layers can be chosen very narrow and can have a corresponding width of less than 1/5 to 1/10 of the associated envelope side width. This leads to a considerable saving of the material used for the envelope without it being necessary to fear any adhesion action towards the inside or outside. This is particularly the case if the energy field projects at the most by the width or not at all over one or both lateral boundaries of the overlapped area or is in fact set back with respect to the particular boundary. Thus, in this case laterally outside the overlapped area or not even in its marginal zone is there in surface-specific manner too much energy so as to activate the adhesive here and instead it is necessarily solidified in these areas, even if it undergoes maximum activation between them. In the direction in which the closing field extends at least up to the outer boundaries of the envelope side, the energy field can be the same or greater than the closing field. Particularly if the adhesive is provided in a much narrower area than the layers to be connected, the said closing field can also be defined by the area taken up by the not yet activated adhesive or that which is taken up by the adhesive after activation or after resolidification.

In place of an emitter to be applied manually to the envelope side, it is appropriately provided in the vicinity of a bearing or contact surface, which at least partly projects over the energy field and which is also suitable in the projecting area for the engagement of the envelope side of the enveloped packed product, i.e. laterally outside the closing field. In place of an upright contact surface it is appropriate to have an at least cross-sectionally approximately horizontal contact surface, in particular a support, on which the enveloped packed product rests with its envelope side at least under its weight force or under an additional pressure force. This contact pressure simultaneously serves to press the adhesive with the layers to be connected, so that the adhesive, in the activated state, penetrates the porous surface of these layers. Adhesive activation appropriately takes place during a conveying movement of the enveloped packed product. The contact surface provided for the envelope side can be movable in the conveying direction and it and/or a conveyor engaging on another side of the enveloped packed product can transfer a feed force to the latter. Instead of concomitantly moving during part of the activation of the adhesive together with the packed product, the energy field is preferably fixed with respect to the apparatus frame, but is optionally adjustably arranged at right angles and/or parallel to the envelope side. In the case of a strip-like construction of the closing field the conveying direction is appropriately roughly parallel to its longitudinal direction and the longitudinal direction of the correspondingly elongated energy field. If the latter is longer than the closing field, then the adhesive is continuously exposed to the energy field over its entire extension during a predetermined conveying path.

A continuous, substantially closed contact surface for the envelope side can only be associated with the energy field by part of its width extension, whilst parts of the contact surface laterally connected to the energy field are so insulated with respect to the emitted energy, that in the vicinity thereof no activating energy can be transferred to the envelope side. Lateral contact surfaces for the envelope side connected laterally with gaps facing to said contact surface can in operation be relatively movable with respect to the contact surface in the conveying direction e.g. in that they are arranged in apparatus-fixed manner or form fixed sliding surfaces for the associated marginal area of the envelope side.

In order to bring about a whole-surface, tightly engaging pressing action of the envelope layers to be connected, the associated contact surface is preferably pressure and/or bending-elastically flexible with respect to the contact pressure in the vicinity of and/or on one or both sides of the energy field. The flexibility in the vicinity of the energy field is appropriately lower than laterally adjacent thereto. In particular if the enveloped packed product, such as in the case of a butt-flush paper stack, has a bending deformability transversely to the energy field under the forces which occur, the surface-specific contact in the vicinity of the closing field can be made slightly higher than in contact areas laterally adjacent thereto. The flexibility of the contact surface can easily be brought about by using a revolving conveyor belt, which in the central area or in the vicinity of the energy field and also spaced therefrom or in its marginal area, but not between the same is supported with respect to the contact surfaces, narrower than the envelope side and is arranged with its lateral edges adjacent to the further contact surfaces. It is also advantageous if a pressing counter-conveyor facing the energy field is narrower than the envelope side, narrower than the lateral spacing between the further contact surfaces and/or narrower than the contact surface having the energy field, but wider than the energy field and/or the internal spacing between the marginal supports of the flexible contact surface. The energy field or the associated contact surface and the counterpressure surface appropriately have a roughly common median plane.

The closing device can operate substantially completely automatically in such a way that the enveloped packed product units are conveyed via an intake station to an inlet-side connecting conveyor, oriented in the latter during a conveying movement with respect to the closing field parallel to the energy field, then moved along the energy field for activating the adhesive and finally in a further continuous passage are transferred to an outlet-side connecting conveyor, which once again reverses during passage the closed packed product units with respect to the orientation of the closing field and transfers same to a removal station. All the conveyors can be driven synchronously and jointly by means of a single drive motor, which is connected by means of gear, chain and/or belt drives with separately mounted and reversed conveyor belts of the individual conveyors.

According to the invention a method for closing packet envelopes is proposed, in which the energy, e.g. thermal and/or pressure energy transferred for the activation of the adhesive is limited to a field surface, which laterally does not or only significantly projects over the closing field. Appropriately in every operating stage of the activation the part of the field surface coinciding with the closing field is at the most slightly larger than the after or is roughly the same size or smaller than the closing field.

BRIEF FIGURE DESCRIPTION

These and further features can be gathered from the claims, description and drawings and the individual features can be realized in individual or subcombination form in an embodiment of the invention and in other fields and can represent advantageous, independently protectable constructions for which protection is hereby claimed. Embodiments of the invention are described in greater detail hereinafter relative to the drawings; wherein show:

FIG. 1 A diagrammatic side view of a closing device according to the invention.

FIG. 2 A plan view of the closing device of FIG. 1.

FIG. 3 A simplified view of a closing device in side view.

FIG. 4 A cross-section through the closing device of FIG. 3 on a larger scale.

DETAILED DESCRIPTION OF A PREFERRED EXAMPLE EMBODIMENT

Figures 1, 2:
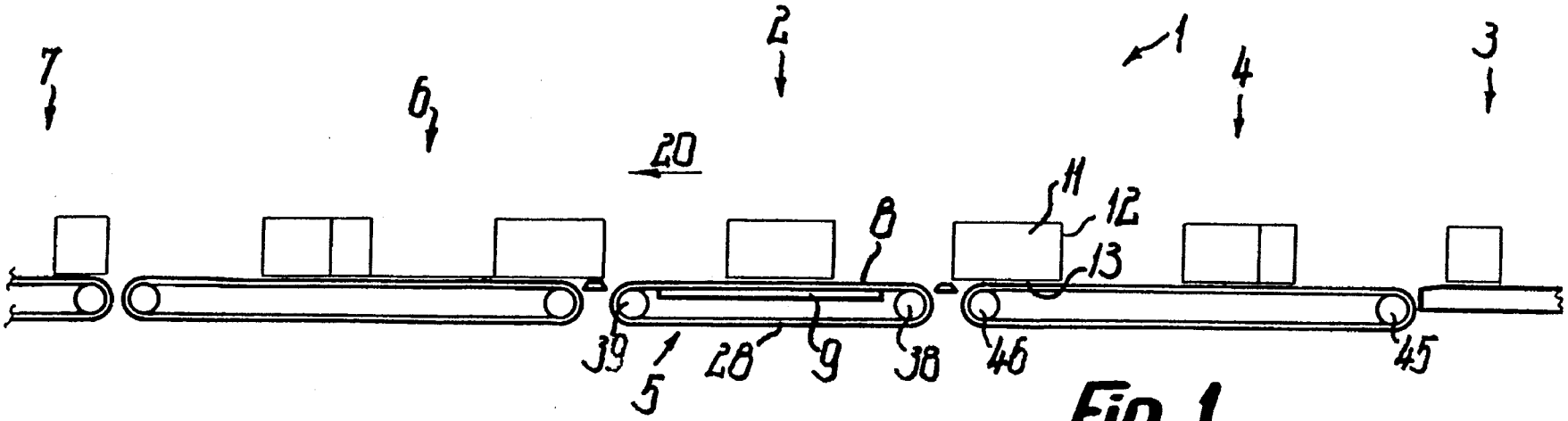

The closing device 1 has a central closing station 2, upstream of which are provided an intake station 3 in the form of a sliding table and a, connecting conveyor 4, which, after taking over from the sliding table, supplies and transfers to a process conveyor 5 of the station 2 the units to be closed. The conveyor 5 transfers the units to a connecting conveyor 6, which supplies and transfers them to a delivery station 7, which can also be a conveyor, a packing machine enveloping a plurality of units, etc. The stations and conveyors essentially define a common conveying plane and continuously convey roughly horizontally, so that the units succeed one another in spaced manner from the taking over by the conveyor 4 to the delivery by the conveyor 6, i.e. also in the vicinity of the station 2 are always roughly linearly moved at least in the conveying direction.

The units are provided by enveloped packed product 11, e.g. by a stack of several hundred sheets of paper, which is so completely enveloped by a wrapping paper envelope 12 on at least four interconnected circumferential sides, that two facing sides are in each case formed by a single sheet. The envelope 12 formed by a rectangular blank forms on one of the two last mentioned sides an envelope side 13, where two marginal strips or layers 14, 15 ere so placed over it that a strip-overlap of roughly constant width is formed, which in its longitudinal direction extends up to the associated ends of the envelope side 13, is located roughly in the centre of the width of said envelope side 13 and is significantly narrower than the latter. On one or both layers 14, 15 is adhesively applied in strip-like manner an adhesive 16, which initially does not join the layers 14, 15 so adhesively that they can only be detached from one another by destroying the adhesive which further, does not project laterally over the two lateral edges of the overlap but is instead slightly set back with respect thereto and which further appropriately in the same way as the overlap extends up to or beyond the associated ends of the packed product 11, so that the envelope at said ends can still be closed by folding over the projecting tube ends provided by the tube-like enclosed envelope 12. The adhesive 16 is applied in the form of an extremely thin, constant width strip, which runs roughly parallel to the overlap and has thermoplastic properties in such a way that it is flowable e.g. at temperatures over 1000° C., but is solid below these temperatures. The outer boundaries of the overlap or the adhesive 16 define a strip-like closing field 17, whose lateral edges 18, 19 extend at the most up to the associated separatingly cut or free longitudinal edges of the layers 14, 15.

The packed product 11 is conveyed solely by friction drive and not by positively shoving cams, so that it can run with random intermediate spacings through the station 2. In the vicinity or through the conveyor 5 there is an approximately planar, plate-like, thin lean bearing 8 for the packed product 11, on whose side remote from the latter is provided an energy emitter 9. The latter emits its thermal energy, e.g. by heat conduction, through the thickness of the contact surface or layer 8 on the contact side thereof and defines there an elongated, strip-like energy field 10, which is parallel to the conveying direction 20 and whose width is at the most the same as the associated width of the closing field 17, but whose length can be greater than that of said field 17. The packed product 11 passes with its envelope side 13 over the energy field 10 in such a way that the median longitudinal plane of its closing field 17 is approximately oriented to the median longitudinal plane of the energy field 10, so that the latter does not laterally project over the closing field 17, during the entire passage.

The lean bearing 8 has several, laterally juxtaposed areas with different characteristics, namely different flexibility, different energy action and different movement behaviour. A central area 21 projecting on either side laterally and at both ends in the direction of the conveying or working plane 42 over the energy field 10, is movable synchronously with the packed product 11 for conveying same in the direction of the arrow 30. This central lean bearing 21 projects on either side of the energy field by an integral multiple of its width. With limited gap spacing is laterally connected to the lateral edges of the contact area of the lean bearing 21 in each case one lateral contact area 22 of a lateral lean bear, 23, with respect to which the area 21 performs the conveying movement, the contact surfaces of all the areas lean bearings 21, 22, 23 being appropriately roughly in a common plane. The planes of the surfaces of lateral lean bearings 22, 23 can be set back in gap-like manner, e.g. by approximately 1 mm with respect to the surface of the contact area 21, so that the packed product 11 in the vicinity of the area 21 engages with a higher specific contact pressure than in the vicinity of the areas 22, 23.

In the vicinity of the energy field 10 or the closing field 17 the pressure and/or bending-elastic contact surface 21 is inelastically rigidly supported against the pressure of the packed product 11 on its back or underside with a central support 24, the latter being formable by the associated energy output side of a cross-sectionally rectangular metal heating rod, or which is flattened on said side and which forms the apparatus-fixing emitter 9 and which slides on the surface 21. In a view of the working plane 42 the width of the support 24 is at the most as great as the width of the energy field 10 or closing field 17 and is roughly symmetrically oriented thereto.

Laterally adjacent to the support 24, the contact surface 21 is supported against the pressure of the packed product 11 with corresponding rigid marginal supports 25, 26, which extend approximately up to the associated lateral longitudinal edge of the contact surface 21, but can also be set back by a small amount with respect thereto. The support-free area of the contact surface 21 between the support 24 and the support 25 or 26 can be of the same width or wider than the support 24. The width of the supports 25, 26 can be smaller than this. In the vicinity of the supports 24, 25, 26 only the thickness of the contact surface 21 can be pressure-elastically compressed, whereas it can give way under bending deformation between the supports.

Figure 4:
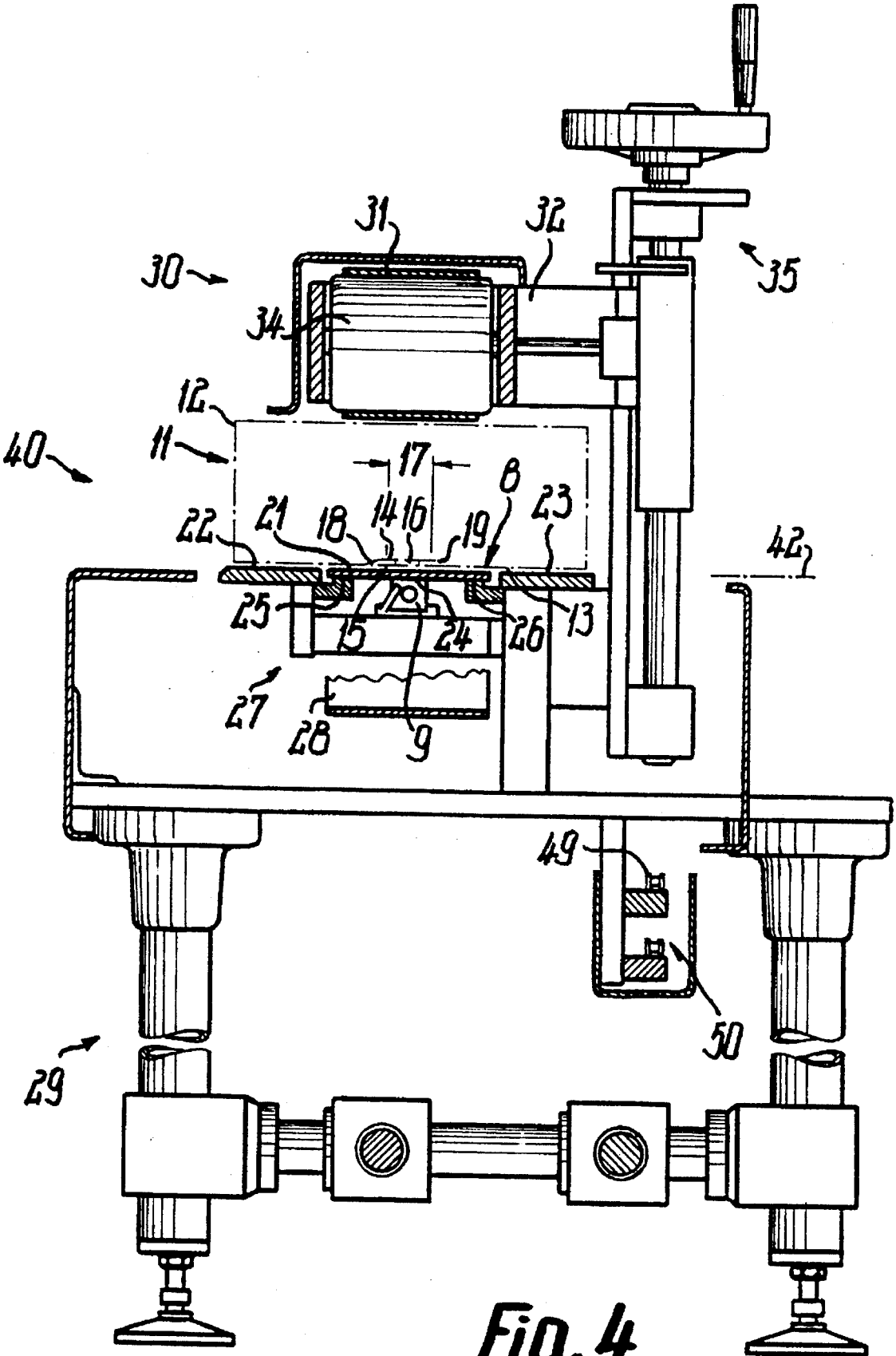

The emitter 9 or the support 24 and a marginal support 25, as well as an associated lateral contact surface 22 fixed thereto are combined to form a closed, fittable standard component 27, which can be removed as a whole in such a way that the associated side of the contact surface 21 still carried by the support 26 is then accessible. In the removed state the emitter 9 is also freely accessible and is easily connected in a non-destructive replaceable manner with a basic element of the standard component 27. This basic element or the standard component 27 is in cross-section according to FIG. 4 fitted in the manner of a freely projecting cantilever bracket, so that on the apparatus frame 29 it is only fixed by bracing along a lateral longitudinal boundary positioned below the frame-fixed marginal support 26.

The contact surface 21 is formed by the associated upper side running in the direction of the arrow 20 of a closed, revolving conveyor belt 28, whose return side is located on the side of the supports 24, 25, 26 remote from the contact surface 21 or below the standard component 27. Thus, the standard component 27 can be drawn out between the two sides. In front of and behind the ends of the energy field 10 the conveyor belt 28 is in each case guided over a roughly horizontal guide or reversal means 38, 39, which are appropriately guide or reversing pulleys only mounted on one side and which in the same way as the standard component freely overhang, so that after removing the component 27 and without any further fitting work the conveyor belt 28 can be drawn off in the same direction and as a whole from the guide means 38, 39. The emitter 9 extends approximately up to the facing sides of the guide means 38, 39, i.e. approximately over the entire length the contact surface 21.

The contact surface 8 or contact surfaces 21, 22, 23 are faced by a counterunit 30, which serves to transfer to the packed product 11 in the conveying direction of arrow 20 a conveying force and/or press the packed product 11 against the energy field 11 in addition to its weight force. The unit 30 has a closed, revolving conveyor belt 31, which is guided over guide or reversing means 33, 34 of a basic element 32 and with the contact surface 8 defines a conveying gap, which is adapted to the associated thickness of the pecked product 11. The lower side of the conveyor belt 31 engaging directly on the side of the packed product 11 remote from the envelope side 13 is roughly of the same length as the contact surface 21 and extends in side view according to FIG. 3 roughly over the same longitudinal area as the contact surface 21, because the intake-side guide means 33, 38 and the outlet-side guide means 34, 39 in each case face one another transversely to the working plane 42. In cross-section according to FIG. 4 the basic element 32 projects in the manner of a cantilever bracket in the same direction as the standard component 27 and the guide means 38, 39 projects freely from an adjusting device 35 with which the basic element 32, including the conveyor belt 31, can be adjusted transversely to the working plane 42, so as to adapt the conveying gap to varyingly thick packed product 11. After removing a protective hood the conveyor belt 31 can be axially removed without further fitting work from the guide means 33, 34 or the unit 30 and then replaced. The adjusting device 35 is provided with a slide manually adjustable on a guide with an adjusting spindle and from which the basic element 32 projects.

As a result of the freely projecting mounting supports and fastenings the conveying gap is always accessible over the full length and/or height from a longitudinal side of the closing device serving as the control or service side 40, in such a way that packed product 11 can be removed in unimpeded manner from said side 40 and at all times it is possible to easily see the conveying gap and process zone. The conveyor belt 31 is driven with the front guide means 34 in the conveying direction of arrow 20 and which is in turn in positive drive connection with the corresponding front guide means 39 of the conveyor belt 28. For this purpose a gear 36 which continuously connects the guide means 34, 39 independently of the setting of the adjusting device 35 is provided and which is positioned laterally adjacent to the outsides of the bearing sides of the guide means 38, 39 or 33, 34 provided on only one side. The guide means 34 can be vertically adjusted with respect to said gear 36 without the drive connection having to be broken or interrupted. Immediately below the contact surface 8 or between the guide means 38, 39 is positioned horizontally and roughly parallel to the arrow 20 a motor of a drive 37, which in turn drives the guide means 39 by a mitre gear and which in turn drives the guide means 34 via the gear 36.

The side of the conveyor belt 31 engaging on the packed product 11 can be deflected slightly towards the contact surface 8 between the guide means 33, 34 with pressure springs 41, so that it always runs on the packed product 11 despite the pressure-elastic flexibility. The pressure springs 41 can be successively arranged in a row in the direction of arrow 20, e.g. between the guide means 33, 34 and can be formed by freely projecting leafspring arms, which have on their free ends runners, on which runs the associated side by the inside thereof. As a result of this construction the conveying gap forms an acute angled, funnel-shaped, narrowing intake end and a correspondingly widened outlet end. However, the contact surface 21 is linearly guided between the guide means 38, 39. In the cross-section according to FIG. 4 the lateral boundaries of the conveyor belt 31 are slightly set back with respect to the lateral boundaries of the contact surface 21 and roughly in the centre of the width of the associated support 25, 26. As a result of the described construction the packed product 11 slightly resilient under the contact pressure can be pressed with its envelope side 13 into the gaps between the supports 24, 25, 26, so that the layers 14, 15 can be reliably pressed against one another. In the vicinity of the supports 34, 35, 36 the contact surface can be slightly compressed.

The two conveyors 4, 6 are formed from substantially identically constructed, uniformly oriented units, which in each case can be detached and replaced in non-destructive manner as a whole, including the relevant frame parts, from the station 2. Each conveyor 4 or 6 has two spaced, juxtaposed individual conveyors 43, 44, which are formed by conveyor belts, which are guided by means of equiaxial guide means 45, 46, which can be driven with the same or variable different speeds. If the packed product 11 is supplied and/or removed in a different orientation from that required in the station 2 with respect to the position of the closing field 7, then it can be oriented during the passage about an axis at right angles to the working plane a before it reaches the contact surface 21. The packed product 11 passes onto the conveyor 4 in such a way that it rests on both upper sides of the individual conveyors 43, 44 and is correspondingly rotated by their differential speeds.

In the vicinity of the gap between the conveyor belts of the conveyor 4 on the one hand and the station 2 on the other there is a fixed gap bridge 52 which is adjustable transversely to the working plane 42 and which reaches and slides over the packed product 11 in the oriented state and then passes in the described manner into the vicinity of the energy field 10. On passing through this area the adhesive 16 becomes fluid, whereby its strip width can slightly increase. Immediately after leaving the end of the energy field 10 the adhesive 16 sets by solidification again, so that the packed product 11 passes over a corresponding gap bridge 52 onto the individual conveyors of the conveyor 6. As a result the packed product 11 can e.g. be reversed in such a way that its closing field 17 is located in the vicinity of the station 3 transversely to the conveying direction of arrow 20. The conveying strip sides of the conveyor 4 or 6 can slightly rise at the start and/or at the end can slightly drop again in acute-angled manner, so that a slightly raised conveying plane is formed with respect to the working plane 42 spaced from the guide means 45, 46 and a better transfer between individual stations is ensured.

Figure 3:
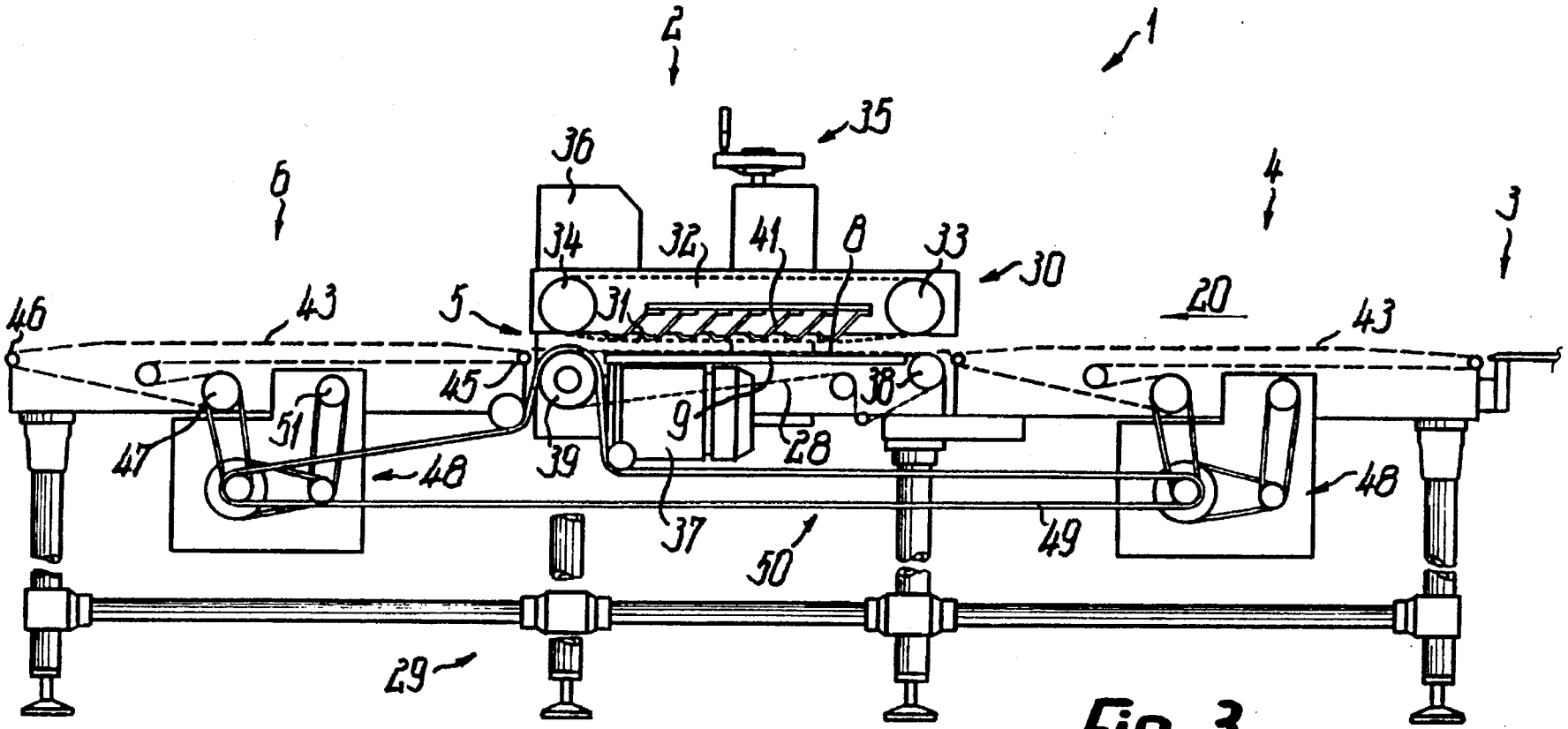

The individual conveyors 43, 44, whereof only one is shown in FIG. 3, are in each case driven by two separate drive shafts 47, 51 by a common intermediate gear 48, which is e.g. constructed as a belt gear and directly below the conveying plane is fixed to the associated frame part. The intermediate gears 48 are driven by the drive 37 by means of a main gear 50, which has a drive tension member in the form of a roller chain 49. The roller chain 49 is guided by means of a chain wheel and from there is guided in revolving manner by means of the intake pinions of the intermediate gears 48. The roller chain 49 is therefore located substantially below the conveying or working plane 42 and over most of its length extends roughly in the conveying direction of arrow 20. The two drive shafts 47, 51 are driven by the associated intake pinions in different speed-reduced manner.

A summary of the operation of an embodiment of the invention is: the product (11) after being enveloped in wrapping paper (12) is fed into the closing station (2) by a conveying motion (20). In station (2), the enveloped product (11) is transported between lower and upper lean bearings (8), (30) while simultaneously the closing field (17) is passed along the energy field emitted by energy emitter (9). The closing field (17) provided by the three layer structures (14), (15), (16) thereby is not in direct contact with the emitter (9). By the energy transmitted through transmitter (28), the adhesive is plasticized, thereby rigidly connecting to the overlapped envelope layers (14), (15) arranged on both sides of adhesive (16). After leaving the energy field emitted by emitter (9) and transmitted by transmitter (28), the adhesive (16) solidifies and establishes a rigid bond between layers (14), (15). Afterwards, the ends of the envelope tube (12) projecting over the leading and trailing ends of product (11) can be folded over these ends and can also be rigidly closed by adhesive or the like.

All these described constructions, components, standard components may be provided individually or in pairs or more, e.g. in order to be able to activate successively and/or simultaneously several closing fields of optionally separate packed product units.

I claim:

1. A closing device for securing a packing envelope (12) of products to be packed, the envelope (12) providing an envelope side (13) including a peripherally bounded closing field (17) provided with an adhesive (16) activatable by an energy supply, said device comprising:

an operating station (2);

an energy emitter (9) located in the vicinity of said operating station (2) and defining an energy field (10), means for bringing the closing field (17) into the vicinity of said energy field (10), each of the envelope side (13), the closing field (17) and said energy field (10) defining two first and second width extensions extending in two substantially perpendicular coordinate directions, and an energy transmitter (28) for transmitting said energy supply from said energy emitter (9) to the closing field (17), said energy transmitter (28) being operationally displaceable with respect to said energy emitter (9).

2. The closing device according to claim 1, wherein at least one of the width extensions of at least one of said energy field (10) is smaller than a parallel width extension of the envelope side (13), at least one of said width extensions of at least one of said energy field (10 being substantially of the same dimension as a parallel width extension of the closing field (17).

3. The closing device according to claim 1 and provided for an envelope (12) of which the closing field (17) is determined by at least one of an overlap of portions of the envelope (12) and an elongated, flat extension of the adhesive (16) and wherein said energy field (10) is elongated in a same manner as the closing field (17), a movable seperator (28) being provided between said energy emitter and at least part of the envelope.

4. The closing device according to claim 1, wherein said energy field (10) is provided in the vicinity of a conveyor (5) determining a conveying direction (arrow 20) for the product (11) when provided with the envelope (10), said conveyor (5) and said energy emitter (9) being provided for activating the adhesive (16) while conveying the product (11), said conveyor (5) providing a contact surface (8) for the envelope side (13) and said energy field (10).

5. The closing device according to claim 1, wherein said energy field (10) has an oblong strip-shaped extension substantially parallel to a conveying direction (12), said energy field (10) being at least one of narrower and between substantially as long as and longer than the closing field (18).

6. The closing device according to claim 1, wherein said energy field (10) is provided in the vicinity of a support provided for receiving the enveloped product (11) under a contact pressure substantially equal to a weight force of the product, a contact member (21) of said support being at least one of substantially closed and permeable for the energy emitted by the energy emitter (9), said energy emitter (9) being located directly adjacent to a side of said contact member remote from a contact side for the product.

7. The closing device according to claim 1, wherein said energy emitter (9) is at least partly covered with respect to the product (11) by a layer providing at least one of flexible and compression elastic properties.

8. The closing device according to claim 1, wherein said energy emitter (9) is shielded with a layer formed by a conveyor belt (28).

9. The closing device according to claim 1, wherein said energy emitter (9) is at least partially surrounded by an insulating covering providing an insulation against the energy to be emitted by said energy emitter (9).

10. The closing device according to claim 1, wherein contact faces for the envelope side (13) substantially free of energy admission by said energy emitter (9) are provided laterally adjacent to and spaced from said energy field (10).

11. The closing device according to claim 1, wherein a yielding thin layer is located on either side of and substantially connecting to said energy field (10), said layer being at least one of substantially free of support on a side remote from a contact side, supported at a spacing from said energy field (10) substantially corresponding to one of said width extension of said energy field (10) and substantially unsupported in laterally outermost areas of said layer.

12. The closing device according to claim 1, wherein a central contact surface (21) for the envelope side (13) is provided in the vicinity of said energy field (10), said contact surface being at least one of narrower than an associated one of said width extension of said envelope side (13) and wider than said energy field (10).

13. The closing device according to claim 1, wherein on either side of a central contact surface (21) for the product are provided at least one of gap spaced connecting surfaces (22, 23) and substantially stationary marginal contact surfaces (22, 23).

14. The closing device according to claim 1, wherein a marginal contact surface (22) for the product located on a service side (40) of said device and including said emitter (9) and an associated support (25) of a central contact surface (21) for the product are provided on a preassembled mounting unit (27) easily and destruction-free detachable independently of additional supporting components.

15. The closing device according to claim 1, wherein at least one counterpressure member is provided for pressing the enveloped product (11) against said energy field (10), one of said at least one counterpressure member being at least one of located above said energy field (10) and at the most substantially as wide as a central contact surface (21) for the product.

16. The closing device according to claim 1, wherein a counterpressure for the product is formed by a counterconveyor driven substantially synchronously with a conveyor (5) for the product and adjustable with respect to said conveyor (5) via a slide.

17. The closing device according to claim 1, wherein at least one of said emitter (9) is at least one of a thermal emitter and an electric emitting bar, at least one of said emitter providing a heated sliding surface for a conveyor (5) for the product.

18. The closing device according to claim 1, wherein said emitter (9) is detachably held in an insulating rail at a side remote from said energy field (10).

19. The closing device according to claim 1, wherein said energy field defines an upstream conveying end and a downstream conveying end, at said upstream conveying end being provided at least one connecting conveyor (4) for supplying the enveloped product (11) and to said downstream conveying end connecting at least one connecting conveyor (6) for conveying the product (11) off.

20. The closing device according to claim 1, wherein a plurality of conveyors (4, 5, 6) is provided for conveying the product, substantially all said conveyors (4, 5, 6) being driven by a central drive (37) of said closing device (1).

21. The closing device according to claim 18, wherein said connecting conveyor (4, 6) is constructed as a preassembled mounting unit including a conveyor base, for connection to said conveying end of a conveyor (5) associated with said energy field (10) a rest support being provided.

22. The closing device according to claim 18, wherein for interruptable drive connection between at least one of said connecting conveyor and an additional conveyor (5) an input shaft is provided.

23. The closing device according to claim 18, wherein said connecting conveyor (4, 6) provides means for reversing the enveloped product (11) about an axis oriented transverse to a conveying plane (42) defined by said connecting conveyor.

24. A method for securing a packing envelope (12) of a product (11) to be packed by activating an adhesive (16) provided between overlapping layer sections (14, 15) of the envelope (12) and associated with a closing field (17) with an activating energy in an energy field (10), in coordinate directions at right angles to one another said energy field (10) and the closing field (17) having in each case associated extensions including a longitudinal extension and a width extension, wherein the enveloped product (11) is only exposed to the activation energy in the vicinity of the closing field (17) while adjacent to the closing field being free from action of the activation energy.

25. The method according to claim 24, wherein the closing field (17) and said energy field (10) are mutually moved in a longitudinal direction and substantially parallel to planes defined by at least one of said energy field (10) and the closing field (17).

* * * * *